US012668900B2

(12) United States Patent
Xu et al.

(10) Patent No.: US 12,668,900 B2
(45) Date of Patent: Jun. 30, 2026

(54) SKIN-FRIENDLY FISH SCALE PROTEIN MODIFIED NYLON-SPANDEX FABRIC AND ITS PROCESSING TECHNOLOGY

(71) Applicant: Xiamen Hexin Technology Co., Ltd., Xiamen (CN)

(72) Inventors: Zhennan Xu, Xiamen (CN); Huawen Tang, Zhongshan (CN)

(73) Assignee: Xiamen Hexin Technology Co., Ltd., Xiamen (CN)

( * ) Notice: Subject to any disclaimer, the term of this patent is extended or adjusted under 35 U.S.C. 154(b) by 1024 days.

(21) Appl. No.: 17/838,467

(22) Filed: Jun. 13, 2022

(65) Prior Publication Data

US 2023/0349078 A1 Nov. 2, 2023

(30) Foreign Application Priority Data

Apr. 27, 2022 (CN) ..... 202210453662.9

(51) Int. Cl.
*D04B 1/14* (2006.01)

(52) U.S. Cl.
CPC ..... *D04B 1/14* (2013.01); *D10B 2211/20* (2013.01); *D10B 2331/02* (2013.01); *D10B 2331/06* (2013.01); *D10B 2331/12* (2013.01)

(58) Field of Classification Search
CPC ..... C08J 2489/00; C08J 2489/04; D01F 1/10; C08L 89/00; C08L 89/04; D10B 2211/00; D10B 2211/06; D10B 2211/20
See application file for complete search history.

(56) References Cited

FOREIGN PATENT DOCUMENTS

| | | | | |
|---|---|---|---|---|
| CN | 102978740 A | * | 3/2013 | |
| CN | 109097900 A | * | 12/2018 | ..... D04B 1/14 |
| CN | 113106768 A | * | 7/2021 | ..... D06P 5/02 |
| CN | 114214747 A | * | 3/2022 | ..... C08J 3/226 |

OTHER PUBLICATIONS

Espacent translation of CN-113106768-A. (Year: 2021).*
Espacenet translation of CN-109097900-A. (Year: 2018).*
Espacenet translation of CN-114214747-A. (Year: 2022).*
Espacenet translation of CN-102978740-A. (Year: 2013).*

* cited by examiner

*Primary Examiner* — Marla D McConnell
*Assistant Examiner* — Christine X Nisula

(57) ABSTRACT

The invention relates to a skin-friendly fish scale protein modified nylon-spandex fabric and its processing technology. The fabric is made of fish scale protein nylon DTY and spandex by weft knitting. The spinning process of the fish scale protein nylon DTY includes the steps of: sequentially carrying out spinning, cooling, oiling and winding on fish scale protein masterbatch and PA6 slices to obtain POY; and then post-processing the POY to obtain the fish scale protein nylon DTY. According to the invention, the fish scale protein masterbatch and the PA6 slices are blended and melt-spun to prepare the fish scale protein nylon DTY, and through special treatment, the PVA crosslinks with and wraps the fish scale protein peptide powder; and then freezing, thawing and crushing are carried out repeatedly to obtain porous PVA-modified fish scale protein peptide powder. On one hand, PVA has good compatibility with the PA6 slices. On the other hand, PVA wraps the fish scale protein peptide powder. In this way, the activity of the fish scale protein can be prevented from damage during the spinning and melting process, the original good antibacterial drying, moisture absorption and moisturizing properties and biocompatibility of the fish scale protein can be maintained and elongation at break can be further enhanced and the spinnability can be improved greatly.

4 Claims, No Drawings

SKIN-FRIENDLY FISH SCALE PROTEIN MODIFIED NYLON-SPANDEX FABRIC AND ITS PROCESSING TECHNOLOGY

This application claims priority to China Application No. CN202210453662.9, filed Apr. 27, which is incorporated herein by reference in its entirety.

BACKGROUND OF THE INVENTION

1. Technical Field

The invention relates to the technical field of underwear fabrics, and in particular to a skin-friendly fish scale protein modified nylon-spandex fabric and its processing technology.

2. Description of Related Art

Collagen has low antigenicity, superior biocompatibility and biodegradability, and has been widely used and of great significance in many fields such as biomedical materials, drug delivery vehicles, tissue engineering, cosmetics, and food. In the prior art, collagen is fixed in nylon 6 filament to make underwear. For example, UMORFIL fiber is made by blended spinning collagen solution and nylon, where the collagen liquid is made of collagen peptide amino acids extracted from deep-sea fish scales using a patented technology.

However, in the actual production process, the collagen spinning solution is directly spun, and the prepared pure collagen spinning solution has poor spinnability and is not easy to form continuous filaments, and many broken ends are caused in the spinning process which deteriorates the quality of collagen fibers, and even hinders the smooth spinning. In addition, the activity of collagen will be destroyed during the spinning process, so even if filaments containing collagen can be obtained, the activity of collagen has been destroyed, which reduces the effect that can be exerted in the actual application process.

BRIEF SUMMARY OF THE INVENTION

An objective of the invention is to provide a skin-friendly fish scale protein modified nylon-spandex fabric and its processing technology, which can maintain the activity of fish scale protein and enhance the mechanical properties.

In order to achieve the above-mentioned objective of the invention, the technical solution of the invention is as follows.

The skin-friendly fish scale protein modified nylon-spandex fabric is made of fish scale protein nylon DTY and spandex by weft knitting. The spinning process of the fish scale protein nylon DTY includes: adding fish scale protein masterbatch and PA6 slices in proportion to a screw extruder, and then successively carrying, out melting, extruding, spinning, cooling, oiling and winding to obtain fish scale protein nylon POY; and post-processing the fish scale protein nylon POY into fish scale protein nylon DTY, wherein the fish scale protein masterbatch is made by blending melting, extrusion granulation and vacuum drying from the following components by mass: 75% to 85% of PA6 slices, 15% to 25% of PVA-modified fish scale protein peptide powder; in the PVA-modified fish scale protein peptide powder, fish scale protein peptide powder accounts for 30% to 55% and PVA accounts for 45% to 70%.

Preferably, the skin-friendly nylon fabric is of a double-sided sandwich structure, and the upper and lower yarns of the double-sided sandwich structure are made of S-twisted fish scale protein nylon DTY and Z-twisted fish scale protein nylon DTY, and the spacer yarns are made of spandex.

Preferably, the fish scale protein, nylon DTY has a D number within a range of 20D to 30D and a yarn count within a range of 16F to 34F; the spandex has a D number within a range of 20D to 30D.

Preferably, the dosage of the fish scale protein masterbatch is within a range of 8% to 25%.

Preferably, the collagen content of the fish scale protein nylon DTY is within a range of 0.3% to 2.5%.

Preferably, the PVA-modified fish scale protein peptide powder is prepared by steps of: preparing an aqueous solution of PVA; ultrasonically dispersing the fish scale protein peptide powder in deionized water, then pouring the resulting fish scale protein peptide powder solution into the aqueous solution of PVA, stirring the mixed solution thoroughly, and adding a boric acid solution dropwise so that the PVA crosslinks with and wraps the fish scale protein peptide powder; and carrying out repeated freeze-drying and crushing to obtain the PVA-modified fish scale protein peptide powder with a porous surface.

The invention further provides a processing technology of a skin-friendly fish scale protein modified nylon-spandex fabric, specifically including: S1, yarn preparation: selecting fish scale protein nylon DTY and spandex as weft knitting yarns, and before weaving, balancing the fish scale protein nylon DTY and the spandex in a workshop for at least 20 hours; S2, weaving: arranging and interweaving the fish scale protein nylon DTY and spandex yarns into a double-sided sandwich grey fabric by using a circular knitting machine; and S3, dyeing and finishing: sequentially carrying out pre-treatment, pre-setting, dyeing, color fixing, water washing and setting finishing on the grey fabric obtained in Step S2, thus obtaining the skin-friendly nylon-spandex fabric.

Preferably, in the setting finishing, the setting temperature is within a range of 190° to 200° C., the speed is 15 Y/min-20 Y/min, the up and down air volume is 90%/95%, and a setting solution contains a high-temperature antioxidant and a hand-feel softener.

Preferably, the dyeing, color fixing and water washing are carried out as follows: placing the grey fabric in a dye vat, and then adding acid dyes, a leveling agent, a dispersant and glacial acetic acid to the dye bath within 10 min to 30 min; heating up to 98° C.±1° C. at a rate of 1° C./min to 2° C./min and, holding the temperature for 20 min to 40 min to carry out dip dyeing; and then cooling down to 60° C. to 70° C., holding the temperature constant, and adding acid color fixing agent to carry out color fixing treatment for 20 min to 30 min; and then cooling down to 40° C. to 50° C. at a rate of 1° C./min to 2° C./min, and washing with water twice to 4 times at this temperature, 15 min to 20 min each time.

Compared with the prior art, the present has the following beneficial effects.

According to the invention, fish scale protein masterbatch and PA6 slices are blended and melt-spun to prepare the fish scale protein nylon DTY, and the fish scale protein masterbatch is specially treated so that the PVA crosslinks with and wraps the fish scale protein peptide powder; and then freezing, thawing and crushing are carried out repeatedly to obtain porous PVA-modified fish scale protein peptide powder. On one hand, PVA with an appropriate degree of hydrolysis is selected to achieve good compatibility with PA6 slices, thus ensuring that DTY can obtain good mechanical properties. On the other hand, PVA diffuses well in water, and a hydrogen bonding effect exists between the fish scale protein and the PV, and then with the help of PVA gel, the fish scale protein peptide powder can be well wrapped, respectively. In this way, the activity of the fish scale protein can be prevented from damage during the spinning and melting process, the original good antibacterial drying, moisture absorption and moisturizing properties and biocompatibility of the fish scale protein can be maintained and the break strength and elongation at break can be further enhanced. Broken ends are hardly caused, which is favorable for weaving and enhancing the spinnability greatly. Moreover, water resistance can also be enhanced.

The collagen content of the fish scale protein nylon DTY of the invention is 0.3% to 2.5%. If the collagen content is less than 0.3%, it is difficult to exert the effect of the fish scale protein. If the collagen content is greater than 2.5%, the spinnability of DTY will be poor. DTY of the invention is suitable for knitted and woven fabrics such as underwear, yoga wear, and the like.

BRIEF DESCRIPTION OF THE SEVERAL VIEWS OF THE DRAWINGS

DETAILED DESCRIPTION OF THE INVENTION

Example 1

This example provides a fish scale protein nylon DTY, and its spinning process includes the steps of: adding fish scale protein masterbatch and PA6 slices in proportion to a screw extruder, wherein the dosage of the fish scale protein masterbatch is 15%; and then sequentially carrying out spinning, cooling, oiling and winding to obtain fish scale protein nylon POY; and then post-processing the fish scale protein nylon POY to obtain the fish scale protein nylon DTY.

Specifically, the spinning process of DTY was carried out as follows. An online masterbatch addition device was used, the fish scale protein masterbatch and the PA6 slices were respectively measured by a metering feeder and then delivered to the screw extruder. The temperatures of zones of the screw and the temperature of the box were 233° C., 236° C., 240° C., 242° C., 234° C. and 226° C., respectively. The fish scale protein masterbatch and the PA6 slices were thoroughly melted, and then mixed and, extruded. After being accurately metered by a metering pump, the melt entered a spinning assembly and was jetted out through a spinneret with 24 holes to form a tow. The tow subjected to monomer suction was cooled by side air blowing. The fibers cooled by side air blowing were accurately metered, oiled and bundle through the oil nozzle. After being oiled, the tow was wound through a pre-entangling device and a godet to obtain the fish scale protein nylon POY. The fish scale protein nylon POY was delivered to the hot box with a temperature of 175° C. via the first roller and the spinning rod guide; after being, cooled by a cooling plate, the fish scale protein nylon POY was falsely twisted at a speed ratio of 1.50; the fish scale protein nylon POY was then drafted by second and third cooling coils at a draw texturing speed of 700 m/min, and a drafting ratio of 1.32. Oiling and rolling were carried out to obtain the fish scale protein nylon DTY.

The fish scale protein masterbatch was made by blending melting, extrusion granulation and vacuum drying from the following components by mass: 75% of PA6 slices and 25% of PVA-modified fish scale protein peptide powder. In the PVA-modified fish scale protein peptide powder, by mass, the fish scale protein peptide powder accounted for 40% and the PVA accounted for 60%.

The fish scale protein masterbatch was specifically prepared as follows. PVA-modified fish scale protein peptide powder was prepared for standby use. Raw materials were quantitatively fed to a parallel bidirectional screw extruder granulator by means of linked feeding at a main feeding position and a side feeding position, where PA6 slices are fed at the main feeding position, the PVA-modified fish scale protein peptide powder was fed at the side feeding position, and the feeding speeds of the main feeding position and the side feeding position were controlled to be 25 Hz. The temperatures of the temperature zones of the screw host and the rotation speed were controlled for melting as follows: the temperature of the first temperature zone was 210° C., the temperature of the second temperature zone was 220° C., the temperature of the third, zone was 225° C., the temperature of the fourth temperature zone was 238° C., the temperature of the fifth temperature zone was 230° C. the temperature of the sixth temperature zone was 210° C., the temperatures of the seventh, eighth and ninth temperature zones were 200° C. the temperature of the nose temperature zone was 200° C., and the speed of the screw host was 600 r/min. Subsequent to melting and plasticizing, the processes of screw shearing, water-cooling pelletizing, screen mesh vibrating and vacuum drying were carried out in sequence to prepare the fish scale protein masterbatch.

The PVA-modified fish scale protein peptide powder was prepared as follows. 60 parts of PVA were added to deionized water to prepare an aqueous solution of PVA with a concentration of 6%, and the degree of hydrolysis of PVA was 88%. 40 parts of the fish scale protein peptide powder were then ultrasonically dispersed in deionized water, and the resulting solution was then poured into the aqueous solution of PVA. The mixed solution was stirred thoroughly and 1% boric acid solution was added dropwise so that the PVA crosslinked with and wrapped the fish scale protein peptide powder. The operations of freezing at −10° C. and thawing at room temperature were carried out for 3 times, and then crushing was carried out to obtain the PVA-modified fish scale protein peptide powder with a porous surface.

Example 2

This example provides a fish scale protein nylon DTY, and its spinning process includes the steps of: adding fish scale protein masterbatch and PA6 slices in proportion to a screw extruder, wherein the dosage of the fish scale protein masterbatch is 8%; and then sequentially carrying out spinning, cooling, oiling and winding to obtain fish scale protein nylon POY; and then post-processing the fish scale protein, nylon POY to obtain the fish scale protein nylon DTY.

Specifically, the spinning process of DTY was carried out as follows. An online masterbatch addition device was used, the fish scale protein masterbatch and, the PA6 slices were respectively measured by a metering feeder and then delivered to the screw extruder. The temperatures of zones of the screw and the temperature of the box were 234° C., 238° C., 240° C., 242° C., 236° C. and 228° C., respectively. The fish scale protein masterbatch and the PA6 slices were thoroughly melted and then mixed and extruded. After being accurately metered by a metering pump, the melt entered a spinning assembly and was jetted out through a spinneret with 16 holes to form a tow. The tow subjected to monomer suction was cooled by side air blowing. The fibers cooled by side air blowing were accurately metered, oiled and bundle through the oil nozzle. After being oiled, the tow was wound through a pre-entangling device and a godet to obtain the fish scale protein nylon POY. The fish scale protein nylon POY was delivered to the hot box with a temperature of 175° C. via the first roller and the spinning rod guide; after being cooled by a cooling plate, the fish scale protein nylon POY was falsely twisted at a speed ratio of 1.50; the fish scale protein nylon POY was then drafted by second and third cooling coils at a draw texturing speed of 700 m/min, and a drafting ratio of 1.32. Oiling and rolling were carried out to obtain the fish scale protein nylon DTY The fish scale protein masterbatch was made by blending melting, extrusion granulation and vacuum drying from the following components by mass: 80% of PA6 slices and 15% of PVA-modified fish scale protein peptide powder. In the PVA-modified fish scale protein peptide powder, by mass, the fish scale protein peptide powder accounted for 40% and the PVA accounted for 60%.

The fish scale protein masterbatch was specifically prepared as follows. PVA-modified fish scale protein peptide powder was prepared for standby use. Raw materials were quantitatively fed to a parallel bidirectional screw extruder granulator by means of linked feeding at a main feeding position and a side feeding position, where PA6 slices are fed at the main feeding position, the PVA-modified fish scale protein peptide powder was fed at the side feeding position, and the feeding speeds of the main feeding position and the side feeding position were controlled to be 25 Hz. The temperatures of the temperature zones of the screw host and the rotation speed were controlled for melting as follows: the temperature of the first temperature zone was 210° C., the temperature of the second temperature zone was 220° C., the temperature of the third zone was 225° C., the temperature of the fourth temperature zone was 240° C., the temperature of the fifth temperature zone was 230° C., the temperature of the sixth temperature zone was 215° C., the temperatures of the seventh, eighth and ninth temperature zones were 205° C., the temperature of the nose temperature zone was 200° C., and the speed of the screw host was 500 r/min. Subsequent to melting and plasticizing, the processes of screw shearing, water-cooling pelletizing, screen mesh vibrating and vacuum drying were carried out in sequence to prepare the fish scale protein masterbatch.

The PVA-modified fish scale protein peptide powder was prepared as follows. 60 parts of PVA were added to deionized water to prepare an aqueous solution of PVA with a concentration of 5%, and the degree of hydrolysis of PVA was 85%. 40 parts of the fish scale protein peptide powder were then ultrasonically dispersed in deionized water, and the resulting solution was then poured into the aqueous solution of PVA. The mixed solution was stirred thoroughly and 1° boric acid solution was added dropwise so that the PVA crosslinked with and wrapped the fish scale protein peptide powder. The operations of freezing at −10° C. and thawing at room temperature were carried out for 2 times, and then crushing was carried out to obtain the PVA-modified fish scale protein peptide powder with a porous surface.

Example 3

This example provides a fish scale protein nylon DTY, and its spinning process includes the steps of: adding fish scale protein masterbatch and PA6 slices in proportion to a screw extruder, wherein the dosage of the fish scale protein masterbatch is 25%; and then sequentially carrying out, spinning, cooling, oiling and, winding to obtain fish scale protein nylon POY; and then post-processing the fish scale protein nylon POY to obtain the fish scale protein nylon DTY.

Specifically, the spinning process of DTY was carried out as follows. An online masterbatch addition device was used, the fish scale protein masterbatch and the PA6 slices were respectively measured by a metering feeder and then delivered to the screw extruder. The temperatures of zones of the screw and the temperature of the box were 232° C. 234° C., 238° C., 238° C., 232° C. and 226° C., respectively. The fish scale protein masterbatch and the PA6 slices were thoroughly melted and then mixed and extruded. After being accurately metered by a metering pump, the melt entered a spinning assembly and was jetted out through a spinneret with 34 holes to form a tow. The tow subjected to monomer suction was cooled by side air blowing. The fibers cooled by side air blowing were accurately metered, oiled and bundle through the oil nozzle. After being, oiled, the tow was wound through a pre-entangling device and a godet to obtain the fish scale protein nylon POY. The fish scale protein nylon POY was delivered to the hot box with a temperature of 175° C. via the first roller and the spinning rod guide; after being cooled by a cooling plate, the fish scale protein nylon POY was falsely twisted at a speed ratio of 1.50; the fish scale protein nylon POY was then drafted by second and third cooling coils at a draw texturing speed of 700 m/min, and a drafting ratio of 132. Oiling and rolling were carried out to obtain the fish scale protein, nylon DTY.

The fish scale protein masterbatch was made by blending melting, extrusion granulation and vacuum drying from the following components by mass: 81.5% of PA6 slices and 18.5% of PVA-modified fish scale protein peptide powder. In the PVA-modified fish scale protein peptide powder, by mass, the fish scale protein peptide powder accounted for 50% and the PVA accounted for 50%.

The fish scale protein masterbatch was specifically prepared as follows. PVA-modified fish scale protein peptide powder was prepared for standby use. Raw materials were quantitatively fed to a parallel bidirectional screw extruder granulator by means of linked feeding at a main feeding position and a side feeding position, where PA6 slices are fed at the main feeding position, the PVA-modified fish scale protein peptide powder was fed at the side feeding position, and the feeding speeds of the main feeding position and the side feeding position were controlled to be 20 Hz. The temperatures of the temperature zones of the screw host and the rotation speed were controlled for melting as follows: the temperature of the first temperature zone was 210° C., the temperature of the second temperature zone was 220° C., the temperature of the third zone was 225° C., the temperature of the fourth temperature zone was 236° C., the temperature of the fifth temperature zone was 226° C., the temperature of the sixth temperature zone was 205° C., the temperatures of the seventh, eighth and ninth temperature zones were 200° C., the temperature of the nose temperature zone was 200° C., and the speed of the screw host was 400 r/min. Subsequent to melting and plasticizing, the processes of screw shearing, water-cooling pelletizing, screen mesh vibrating and vacuum drying were carried out in sequence to prepare the fish scale protein masterbatch.

The PVA-modified fish scale protein peptide powder was prepared as follows. 50 parts of PVA were added to deionized water to prepare an aqueous solution of PVA with a concentration of 10%, and the degree of hydrolysis of PVA was 88%. 50 parts of the fish scale protein peptide powder were then ultrasonically dispersed in deionized water, and the resulting solution was then poured into the aqueous solution of PVA. The mixed solution was stirred thoroughly and 1.5% boric acid solution was added dropwise so that the PVA crosslinked with and wrapped the fish scale protein peptide powder. The operations of freezing at −5° C. and thawing at room temperature were carried out for 4 times, and then crushing was carried out to obtain the PVA-modified fish scale protein peptide powder with a porous surface.

Example 4

This example provides a fish scale protein nylon DTY, and its spinning process includes the steps of: adding fish scale protein masterbatch and PA6 slices in proportion to a screw extruder, wherein the dosage of the fish scale protein masterbatch is 12%; and then sequentially carrying out spinning, cooling, oiling and winding to obtain fish scale protein nylon POY; and then post-processing the fish scale protein nylon POY to obtain the fish scale protein nylon DTY.

Specifically, the spinning process of TTY was carried out as follows. An online masterbatch addition device was used, the fish scale protein masterbatch and the PA6 slices were respectively measured by a metering feeder and then delivered to the screw extruder. The temperatures of zones of the screw and the temperature of the box were 232° V, 234° C., 238° C., 238° C., 232° C. and 226° C., respectively. The fish scale protein masterbatch and the PA6 slices were thoroughly melted and then mixed and extruded. After being accurately metered by a metering pump, the melt entered a spinning assembly and was jetted out through a spinneret with 24 holes to form a tow. The tow subjected to monomer suction was cooled by side air blowing. The fibers cooled by side air blowing were accurately metered, oiled and bundle through the oil nozzle. After being oiled, the tow was wound through a pre-entangling device and a godet to obtain the fish scale protein nylon POY. The fish scale protein nylon POY was delivered to the hot box with a temperature of 175° C. via the first roller and the spinning rod guide; after being cooled by a cooling plate, the fish scale protein nylon POY was falsely twisted at a speed ratio of 1.50; the fish scale protein nylon POY was then drafted by second and third cooling coils at a draw texturing speed of 700 m/min, and a drafting ratio of 1.32. Oiling and rolling were carried out to obtain the fish scale protein nylon DTY.

The fish scale protein masterbatch was made by blending melting, extrusion granulation and vacuum drying from the following components by mass: 85% of PA6 slices and 15% of PVA-modified fish scale protein peptide powder. In the PVA-modified fish scale protein peptide powder, by mass, the fish scale protein peptide powder accounted for 45% and the PVA accounted for 55%.

The fish scale protein masterbatch was specifically prepared as follows. PVA-modified fish scale protein peptide powder was prepared for standby use. Raw materials were quantitatively fed to a parallel bidirectional screw extruder granulator by means of linked feeding at a main feeding position and a side feeding position, where PA6 slices are fed at the main feeding position, the PVA-modified fish scale protein peptide powder was fed at the side feeding position, and the feeding speeds of the main feeding position and the side feeding position were controlled to be 20 Hz. The temperatures of the temperature zones of the screw host and the rotation speed were controlled for melting as follows: the temperature of the first temperature zone was 210° C., the temperature of the second temperature zone was 220° C., the temperature of the third zone was 225° C., the temperature of the fourth temperature zone was 236° C., the temperature of the fifth temperature zone was 226° C., the temperature of the sixth temperature zone was 205° C., the temperatures of the seventh, eighth and ninth temperature zones were 200° C., the temperature of the nose temperature zone was 200° C., and the speed of the screw host was 400 r/min. Subsequent to melting and plasticizing, the processes of screw shearing, water-cooling pelletizing, screen mesh vibrating and vacuum drying were carried out in sequence to prepare the fish scale protein masterbatch.

The PVA-modified fish scale protein peptide powder was prepared as follows. 55 parts of PVA were added to deionized water to prepare an aqueous solution of PVA with a concentration of 10%, and the degree of hydrolysis of PVA was 88%. 45 parts of the fish scale protein peptide powder were then ultrasonically dispersed in deionized water, and the resulting solution was then poured into the aqueous solution of PVA. The mixed solution was stirred thoroughly and 1.5% boric acid solution was added dropwise so that the PVA crosslinked with and wrapped the fish scale protein peptide powder. The operations of freezing at −5° C. and thawing at room temperature were carried out for 4 times, and then crushing was carried out to obtain the PVA-modified fish scale protein peptide powder with a porous surface.

Example 5

This example provides a skin-friendly fish scale protein modified nylon-spandex fabric and its processing technology includes the following steps.

Step S1, yarn preparation: N20/24SD S-twisted fish scale protein nylon DTY and N20/24SD Z-twisted fish scale protein nylon DTY were selected as the upper yarns, spandex E20D was selected as the spacer yarns, and N20/24SD S-twisted fish scale protein nylon DTY and N20/24SD Z-twisted fish scale protein nylon DTY were selected as the lower yarns. The fish scale protein nylon DTY was the DTY obtained in Example 1. Before weaving, the yarns were required to be balanced in a workshop for 24 hours, the ambient temperature was controlled at 25° C., and the ambient humidity was controlled at 65%.

S2, weaving: the fish scale protein nylon DTY and the spandex yarns were arranged and interwoven into a double-sided sandwich grey fabric by using a circular knitting machine. The use ratios of the Z-twisted fish scale protein nylon DTY, the S-twisted fish scale protein nylon DTY and the spandex E20D were 33.5%, 33.5% and 33% respectively, and the density were WPI: 63, CPI: 95.

S3, pretreatment: the double-sided sandwich grey fabric obtained in Step S2 was dipped in a pretreatment solution, and treated at 85° C. for 20 minutes to remove the spinning and weaving oil. The pretreatment solution in this example included a 1.0 g/L refining agent and a 1.0 g/L aqueous solution of emulsifier.

S4, presetting: the pre-setting was carried out for 10 minutes at a temperature of 195° C. at a speed of 25 m/min. After pre-setting, the grey fabric was hemmed and then trimmed.

S5, dyeing, color fixing and water washing: the grey fabric was placed in a dye vat, and then acid dyes, a leveling agent, a dispersant and glacial acetic acid were added to the dye bath within 30 min; the grey fabric was heated up to 98° C. at a rate of 1° C./min to 2° L/min and then held at this temperature for 30 minutes to carry out dip dyeing. After dip dyeing, the grey fabric was cooled down to 65° C. and held at this temperature constantly, and an acid color fixing agent was added to carry out color fixing treatment for 25 min; and the grey fabric was then cooled down to 40° C. at a rate of 1.5° C./min, and then washed with water 3 times at this temperature, 20 min each time.

S6, dehydration out of the dye vat, setting and finishing: the setting was carried out at 200° C. at a speed of 15 Y/min, with an up and down air volume of 90%/95% to obtain the skin-friendly nylon-spandex fabric, where a setting solution used contained a 20 g/L high-temperature antioxidant GS-1122 and a 2 g/L hand-feel, softener.

Example 6

This example provides a skin-friendly fish scale protein modified nylon-spandex fabric and its processing technology includes the following steps.

Step S1, yarn preparation: N20/16SD S-twisted fish scale protein nylon DTY and N20/16SD Z-twisted fish scale protein nylon DTY were selected as the upper yarns, spandex E20D was selected as the spacer yarns, and N20/16SD S-twisted fish scale protein nylon DTY and N20/16SD Z-twisted fish scale protein nylon DTY were selected as the lower yarns. The fish scale protein nylon DTY was the DTY obtained in Example 2. Before weaving, the yarns were required to be balanced in a workshop for 24 hours, the ambient temperature was controlled at 25° C., and the ambient humidity was controlled at 70%.

S2, weaving: the fish scale protein nylon DTY and the spandex yarns were arranged and interwoven into a double-sided sandwich grey fabric by using a circular knitting machine. The use ratios, of the Z-twisted fish scale protein nylon DTY, the S-twisted fish scale protein nylon DTY and the spandex E20D were 33.5%, 33.5% and 33% respectively, and the density were WPI: 63, CPI: 95.

S3, pretreatment: the double-sided sandwich grey fabric obtained in Step S2 was dipped in a pretreatment solution, and treated at 80° C. for 30 minutes to remove the spinning and weaving oil. The pretreatment solution in this example included a 1.5 g/L refining agent and a 2.0 g/L aqueous solution of emulsifier.

S4, presetting: the pre-setting was carried out for 15 minutes at a temperature of 190° C. at a speed of 20 m/min. After pre-setting, the grey fabric was hemmed and then trimmed.

S5, dyeing, color fixing and water washing: the grey fabric was placed in a dye vat, and then acid dyes, a leveling agent, a dispersant and glacial acetic acid were added to the dye bath within 20 min; the grey fabric was heated up to 98° C. at a rate of 2° C./min and then held at this temperature for 40 minutes to carry out dip dyeing. After dip dyeing, the grey fabric was cooled down to 60° C. and held at this temperature constantly, and an acid color fixing agent was added to can y out color fixing treatment for 30 min; and the grey fabric was then cooled down to 45° C. at a rate of 1.0° C./min, and then washed with water 4 times at this temperature, 15 min each time.

S6, dehydration out of the dye vat, setting and finishing: the setting was carried out at 190° C. at a speed of 20 Y/min, with an up and down air volume of 90%195% to obtain the skin-friendly nylon-spandex fabric, where a setting solution used contained a 25 g/L high-temperature antioxidant GS-1122 and a 3 g/L hand-feel softener.

Example 7

This example provides a skin-friendly fish scale protein modified nylon-spandex fabric and its processing technology includes the following steps.

Step S1, yarn preparation: N30/34SD S-twisted fish scale protein nylon DTY and N30/34SD Z-twisted fish scale protein nylon DTY were selected as the upper yarns, spandex E20D was selected as the spacer yarns, and N30/34SD S-twisted fish scale protein nylon DTY and N30/34SD Z-twisted fish scale protein nylon DTY were selected as the lower yarns. The fish scale protein nylon DTY was the DTY obtained in Example 3. Before weaving, the yarns were required to be balanced in a workshop for 24 hours, the ambient temperature was controlled at 25° C. and the ambient humidity was controlled at 60%.

S2, weaving: the fish scale protein nylon DTY and the spandex yarns were arranged and interwoven into a double-sided sandwich grey fabric by using a circular knitting machine. The use ratios of the Z-twisted fish scale protein nylon DTY, the S-twisted fish scale protein nylon DTY and the spandex E20D were 33.5%, 33.5% and 33% respectively, and the density were WPI: 63, CPI: 95.

S3, pretreatment: the double-sided sandwich grey fabric obtained in Step S2 was dipped in a pretreatment solution, and treated at 85° C. for 20 minutes to remove the spinning and weaving oil. The pretreatment solution in this example included a 1.0 g/L refining agent and a 1.5 g/L aqueous solution of emulsifier.

S4, presetting: the pre-setting was carried out for 20 minutes at a temperature of 190° C. at a speed of 30 m/min. After pre-setting, the grey fabric was hemmed and then trimmed.

S5, dyeing, color fixing and water washing: the grey fabric was placed in a dye vat, and then acid dyes, a leveling agent, a dispersant and glacial acetic acid were added to the dye bath within 30 min; the grey fabric was heated up to 98° C. at a rate of 1.5° C./min and then held at this temperature for 30 minutes to carry out dip dyeing. After dip dyeing, the grey fabric was cooled down to 70° C. and held at this temperature constantly, and an acid color fixing agent was added to carry out color fixing treatment for 20 min; and the grey fabric was then cooled down to 50° C. at a rate of 2.0° C./min, and then washed with water 2 times at, this temperature, 20 min each time.

S6, dehydration out of the dye vat, setting and finishing: the setting was carried out at 200° C. at a speed of 15 Y/min, with an up and down air volume of 90%/95% to obtain the skin-friendly nylon-spandex fabric, where a setting solution used contained a 30 g/L high-temperature antioxidant GS-1122 and a 5 g/L hand-feel softener.

Comparative Example 1

Comparative Example 1 differs from Example 1 in that the fish scale protein masterbatch was made by blending melting, extrusion granulation and vacuum drying from the following components by mass: 75% of PA6 slices, 10% of fish scale protein peptide powder and 15% of PVA.

The preparation method of the fish scale protein masterbatch in Comparative Example 1 differs from that in Example 1 only in no preparation of PVA-modified fish scale protein peptide powder and in material feeding mode. Specifically, the fish scale protein masterbatch in Comparative Example 1 was fed as follows: raw materials were quantitatively fed to a parallel bidirectional screw extruder granulator by means of linked feeding at a main feeding position and a side feeding position, where PA6 slices are fed at the main feeding position, fish scale protein peptide powder and PVA were fed at the side feeding position, and the feeding speeds of the main feeding position and the side feeding position were controlled to be 25 Hz.

The DTY spinning process is the same as the process parameters of Example 1.

Comparative Example 2

Comparative Example 2 differs from Example 1 only in the following. The fish scale protein masterbatch is replaced by the PVA-fish scale protein mixed solution, and the dosage of the PVA-fish scale protein mixed solution is 15%. The PVA-fish scale protein mixed solution was prepared as follows: PVA was dissolved in deionized water, the fish scale protein peptide powder was dissolved in, the aqueous solution of acetic acid, the aqueous solution of PVA and the collagen solution were then mixed to obtain the PVA-fish scale protein mixed solution. The PVA content in the PVA-fish scale protein mixed solution is the same as the PVA content in the fish scale protein masterbatch of Example 1, and the content of the fish scale protein peptide powder in the PVA-fish scale protein mixed solution is the same as that in the fish scale protein masterbatch of Example 1.

The DTY spinning process is the same as the process parameters of Example 1.

Comparative Example 3

Comparative Example 3 differs from Example 1 in that the fish scale protein masterbatch was made by blending melting, extrusion granulation and vacuum drying from the following components by mass: 90% of PA6 slices and 10% of fish scale protein peptide powder. The preparation method of the fish scale protein masterbatch in Comparative Example 1 differs from that in Example 3 only in no preparation of PVA-modified fish scale protein peptide powder and in material feeding mode. Specifically, the fish scale protein masterbatch in Comparative Example 1 was fed as follows: raw materials were quantitatively fed to a parallel bidirectional screw extruder granulator by means of linked feeding at a main feeding position and a side feeding position, where PA6 slices are fed at the main feeding position, fish scale protein peptide powder was fed at the side feeding position, and the feeding speeds of the main feeding position and the side feeding position were controlled to be 25 Hz.

The DTY spinning process is the same as the process parameters of Example 1.

Comparative Example 4

Comparative Example 4 differs from Example 1 in that the degree of hydrolysis of PVA is 98%.

It should be noted that the fish scale protein peptide powder of the invention is type I collagen. The fish scale protein nylon DTY of the invention is also suitable for other knitted and woven structures, such as plain weave, twill weave, double weft, five satin weave, and the like.

The fish scale protein nylon DTY fabrics prepared in Examples 1 to 2 (denoted as L1-L4) and Comparative Example 1 to 4 (denoted as D1 to D4) were respectively taken for physical property test, and the test results are shown in Table 1.

TABLE 1

Physical property test results of nylon DTY fabrics from Examples 1 to 3 and Comparative Examples 1 to 3 of the invention

| | | L1 | L2 | L3 | L4 | D1 | D2 | D3 | D4 | Test standard |
|---|---|---|---|---|---|---|---|---|---|---|
| Break strength cN/dtex | | 4.71 | 4.63 | 4.60 | 4.67 | 4.50 | 4.56 | 4.45 | 4.34 | GB/T |
| Elongation at break % | | 41.2 | 40.2 | 39.7 | 40.8 | 30.2 | 36.2 | 28.5 | 26.2 | 14344-2008 |
| Collagen % | | 1.5 | 0.48 | 2.31 | 0.81 | 1.42 | 1.44 | 1.34 | 1.49 | FZ/T 50018 |
| Shrinkage in boiling water % | | 4.76 | 4.8 | 4.82 | 4.78 | 5.12 | 4.91 | 5.30 | 5.02 | GB/T 6505-2008 |
| Antibacterial performance % | *Escherichia coli* | 72.2 | 70.8 | 72.9 | 71.6 | 71.4 | 70.3 | 71 | 71.5 | GB/T 20944.3-2008 |
| | *Staphylococcus aureus* | 99.5 | 99.1 | 99.6 | 99.3 | 99.4 | 97.1 | 99.3 | 99.1 | |
| | Candida albicans | 97.7 | 97.2 | 98.2 | 97.5 | 98.0 | 95.2 | 97.1 | 97.5 | |

In addition, through the test in accordance with GB/T 3921-2008 (40° C., 30 min), the soaping fastness of the nylon-spandex fabrics of Examples 5 to 7 are all above grade 4-5. Through the test (40° C., 30 min) in accordance with GB/T 3922-2008, the perspiration fastness of the nylon-spandex fabrics of Examples 5 to 7 are all above grade 4. Through the test in accordance with GB/T 35263-2017, the contact cooling coefficient of the nylon-spandex fabrics of Examples 5 to 7 are 0.22-0.26 J/(cm·s). According to the same method, the collagen content of the nylon-spandex fabric of Comparative Example 3 was decreased by 12.8% as compared with the collagen content of the nylon-spandex fabric of Example 1.

The basic principles and main features of the invention and the advantages of the invention are shown and described above. Those skilled in the industry should understand that the invention is not limited by the above-mentioned embodiments. The above-mentioned embodiments and descriptions only illustrate the principles of the invention. Without departing from the spirit and scope of the invention, the invention will also have various changes and improvements, and these changes and improvements all fall within the scope of the invention, which is defined by the Claims appended and their equivalents.

What is claimed is:

1. A skin-friendly fish scale protein modified nylon-spandex fabric, made of fish scale protein nylon drawn textured yarn and spandex by weft knitting, wherein a spinning process of the fish scale protein nylon drawn textured yarn comprises: adding fish scale protein masterbatch and polyamide 6 slices in proportion to a screw extruder; and then sequentially carrying out spinning, cooling, oiling and winding to obtain fish scale protein nylon pre-oriented yarn; and then post-processing the fish scale protein nylon pre-oriented yarn to obtain the fish scale protein nylon drawn textured yarn;

the fish scale protein masterbatch is made by blending melting, extrusion granulation and vacuum drying from the following components by mass: 75% to 85% of polyamide 6 slices, 15% to 25% of polyvinyl alcohol modified fish scale protein peptide powder; in the polyvinyl alcohol modified fish scale protein peptide powder, the fish scale protein peptide powder accounts for 30% to 55% and polyvinyl alcohol accounts for 45% to 70%;

the polyvinyl alcohol modified fish scale protein peptide powder is prepared by steps of: preparing an aqueous solution of polyvinyl alcohol; ultrasonically dispersing the fish scale protein peptide powder in deionized water, then pouring the resulting fish scale protein peptide powder solution into the aqueous solution of polyvinyl alcohol, stirring the mixed solution thoroughly, and adding a boric acid solution dropwise so that the polyvinyl alcohol crosslinks with and wraps the fish scale protein peptide powder; and carrying out repeated freeze-drying and crushing to obtain the polyvinyl alcohol modified fish scale protein peptide powder with a porous surface;

wherein the collagen content of the fish scale protein nylon drawn textured yarn is within a range of 0.3% to 2.5%.

2. The skin-friendly fish scale protein modified nylon-spandex fabric according to claim 1, the skin-friendly nylon fabric being of a double-sided sandwich structure, upper and lower yarns of the double-sided sandwich structure being made of S-twisted fish scale protein nylon drawn textured yarn and Z-twisted fish scale protein nylon drawn textured yarn, spacer yarns being made of spandex.

3. The skin-friendly fish scale protein modified nylon-spandex fabric according to claim 2, wherein the fish scale protein nylon drawn textured yarn has a denier number within a range of 20D to 30D and a yarn count within a range of 16F to 34F; the spandex has a denier number within a range of 20D to 30D.

4. The skin-friendly fish scale protein modified nylon-spandex fabric according to claim 1, wherein the dosage of the fish scale protein masterbatch is 8% to 25%.

* * * * *